US007752686B2

(12) United States Patent
Polimeno

(10) Patent No.: US 7,752,686 B2
(45) Date of Patent: Jul. 13, 2010

(54) INFINITY SHOWER PAN

(76) Inventor: John Polimeno, 5686 Oakmont Ct., Discovery Bay, CA (US) 94514

( * ) Notice: Subject to any disclaimer, the term of this patent is extended or adjusted under 35 U.S.C. 154(b) by 1239 days.

(21) Appl. No.: 11/111,157

(22) Filed: Apr. 20, 2005

(65) Prior Publication Data

US 2006/0236452 A1 Oct. 26, 2006

(51) Int. Cl.
*A47K 3/00* (2006.01)

(52) U.S. Cl. ..... 4/613

(58) Field of Classification Search ..... 4/612, 4/613

See application file for complete search history.

(56) References Cited

U.S. PATENT DOCUMENTS 6,155,015 A * 12/2000 Kirby ..... 52/302.1
6,202,689 B1 * 3/2001 Williams ..... 137/602
6,851,133 B1 * 2/2005 Nehring ..... 4/613
6,941,703 B2 * 9/2005 MacLean et al. ..... 52/34
2005/0028269 A1 * 2/2005 Furia ..... 4/613

* cited by examiner

*Primary Examiner*—Huyen Le
(74) *Attorney, Agent, or Firm*—Imperium Patent Works LLP; T. Lester Wallace; Amir V. Adibi

(57) ABSTRACT

A shower pan includes a draining base portion that drains to an orifice. The draining base portion includes a support structure for supporting a slab floor member (for example, a single piece of granite, marble, or engineered stone) above the orifice such that a planar upper surface of the floor member has a slight tilt. The pan is installed such that the tilt is toward a shower head. The shower enclosure is finished by cladding the enclosure walls with a finishing material (for example, granite, marble or engineered stone) such that the finishing material extends down into the pan. The floor member is placed on the support structure such that water from the shower head that falls on the floor member runs off one or more edges of the floor member and is conducted to the orifice under the floor member by a draining portion of the draining base portion.

21 Claims, 4 Drawing Sheets

INFINITY SHOWER PAN

TECHNICAL FIELD

The present invention relates to shower pans.

BACKGROUND INFORMATION

Cast cultured marble shower pans are typically installed at the rough-in stage of construction. Because the shower pan is installed so early in the construction process, construction workers perform their trades in the area around the shower pan after the shower pan has already been installed. The construction workers may, for example, drop nails, screws and other building materials in the shower pan, and then walk into the shower, on the shower pan, and over the nails and other debris. Materials that are corrosive or harmful to the material of which the shower pan is made may also be spilled or dumped into the shower pan. The unfortunate result is that the smooth surface of the shower pan is covered in difficult to remove materials, is scratched, is discolored, or is otherwise damaged. A solution is desired.

Another problem is that at the rough-in stage in the construction process when the shower pan is installed, it may not yet be known how the surrounding area will be finished. For example, the type and color of wall covering material that will cover the shower enclosure walls and the other walls of the bathroom may, for example, not have been decided. Paint colors and cabinetry and other aspects of the construction project may remain to be decided, and it is desired to be able to finish the shower enclosure in way that matches or compliments the remainder of the bathroom finishing materials that have yet to be decided. Unfortunately, when the shower pan is installed at the rough-in stage of construction, the color and style of the shower pan has to be decided before these other design decisions have been made. A solution is desired.

Although synthetic cast shower pans function well, the look and feel of the artificial cast material may be less aesthetically pleasing to some than other finishing materials. In some circumstances it may be desired to use natural granite or natural marble for the inside surfaces of the shower. Alternatively, it may be desired to clad the inside of the shower in a beautiful artificial engineered stone material such as Silestone. To finish the shower in the chosen finishing material, however, a mason or specialized installer is typically required to cut pieces of the finishing materials and to tile or otherwise fix the cut pieces of the finishing materials to the inside walls of the shower enclosure. Sometimes finishing materials are to be applied to the floor of the shower and the same expertise is often required to tile the floor of the shower with finishing materials. The labor associated with this cladding operation can entail substantial cost. Moreover, a shower enclosure will typically have a drain located in a somewhat central location. The mason or installer attempts to places pieces of the cladding material on the floor of the shower such that the joints between pieces align with the shower drain in a substantially symmetrical and pleasing way. Unfortunately, getting the pieces to align in this way is often difficult and expensive. The resulting cladding of the shower enclosure can have a conspicuous asymmetry around the location of the drain. A solution is desired.

In addition to the above described problems, there is a constant demand for new and distinctive bathroom designs and looks. An economical, new and distinctive shower design that allows a shower enclosure to be finished with a selectable one of many different cladding materials is desired.

SUMMARY

A shower pan includes sidewalls and a draining base portion. The draining base portion includes a draining portion that drains to a drain orifice. The draining base portion further includes a support structure for supporting a slab floor member above the orifice such that a planar upper surface of the floor member has a slight tilt. The slab floor member can, for example be a single piece of granite, a single piece of marble, a single piece of engineered stone such as Silestone, a single piece of cultured marble, a single piece of cultured granite, a single piece of cultured onyx, a single piece of glass, a single piece of another synthetic countertop or shower-cladding material, a plurality of ceramic tiles that are fixed to a rigid backing board, or a plurality of pieces of any of the above materials arranged in a pattern and fixed to a rigid backing board.

The shower pan is installed such that the slight tilt of the upper surface of the slab floor member will be toward the shower head in the finished shower enclosure. The shower pan is protected during the rough-in stage of construction by a disposable slab floor member.

The shower enclosure is then finished by cladding the walls of the enclosure with a finishing material (for example, granite, marble, synthetic material, engineered stone, glass, tile, or combinations of the above) such that the bottom edge of the finishing material that clads the shower enclosure walls extends down into the pan. The disposable slab floor member is then removed and the final slab floor member is placed on the support structure such that water from the shower head that falls on the final slab floor member will run off one or more edges of the slab floor member and will be conducted to the orifice under the floor member by the draining portion of the draining base portion of the pan.

The final slab floor member in the final installation is not glued to the support structure of the shower pan, but rather rests on the support structure and is held in place by gravity. In some embodiments, the slab floor member has an indent that engages a portion of the support structure that extends up past the plane of the support plane so that once the indent-in the slab floor member is put in place over the portion, the slab floor member is thereafter held in place and prevented from slipping. Other mechanisms for preventing excessive movement of the slab floor member are employed in other embodiments.

The shower pan is called the "Infinity Shower Pan" because water can be thought as sheeting off the peripheral edges of the slab floor member in a similar fashion to the way waves of water are terminated at the edges of an infinity swimming pool.

Multiple different shower pan configurations are possible that both drain to a drain orifice and also include the novel support structure. In one example, the support structure contacts a large proportion of the underside planar surface of the slab floor member, thereby minimizing the air space underneath the slab floor member. A peripheral drain trough formed in the upper surface of the shower pan catches water that falls off the peripheral edges of the slab floor member. The peripheral drain trough conducts this water into a drain channel that extends to the drain orifice located under the slab floor member in the center of the shower pan. A removable screen or grill is provided to filter water as it passes from the peripheral drain trough into the drain channel.

In one novel aspect, a novel shower pan and a novel threshold extension portion is available for retail purchase. A wide selection of cladding kits are also made available for retail purchase. Each cladding kit includes a set of precut cladding sheets for cladding the walls of the shower enclosure, a set of precut cladding pieces for cladding the threshold portion, and a precut slab floor member made of the same cladding material. An individual can purchase the shower pan and threshold extension portion at a retail store, and install the shower pan at the rough-in stage of construction without having to decide which cladding material will later be used to finish the installation. Later, when the shower enclosure is to be finished, the individual consults the large selection of available cladding kits and selects a cladding kit that has a desired finishing material and look. Because the cladding sheets and pieces in each kit are precut, the finishing of the shower enclosure is simplified and made less expensive. The precut cladding pieces can be mass-produced, thereby reducing per unit cost and decreasing the cost of the cladding kits.

Other structures and methods are disclosed in the detailed description below. This summary does not purport to define the invention. The invention is defined by the claims

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
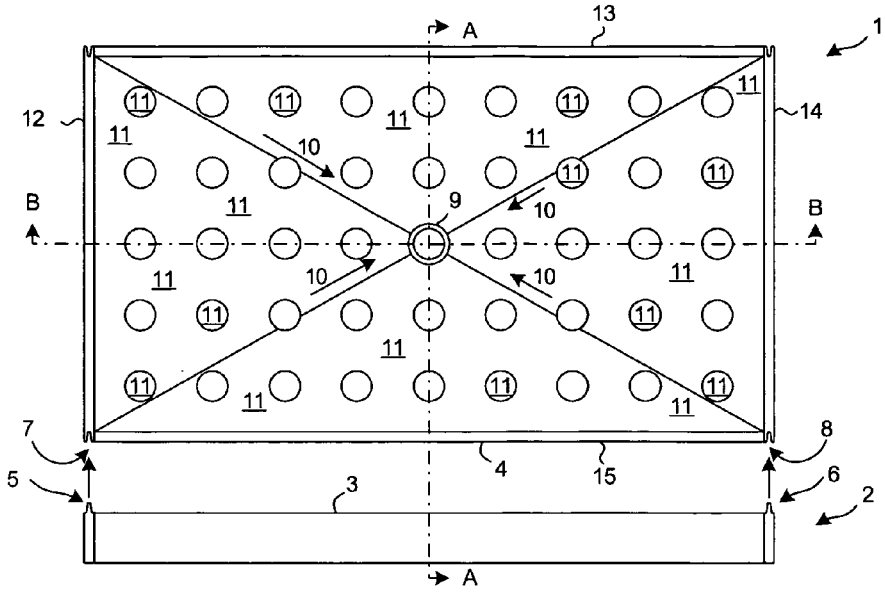
FIG. 1 is top-down view of a shower pan and threshold extension portion in accordance with one novel aspect.

FIG. 1 is a simplified top-down diagram of a novel shower pan 1 and threshold extension portion 2. Both the shower pan and the threshold extension portion are unitary articles. Each article may, for example, be a cast cured resin article.

In a first example, each of the two articles is a cast piece of cultured marble. To make one of the articles, a liquid polyester resin material is used as a starting ingredient. An effective amount of a catalyst such as an organic peroxide is added to the liquid polyester material and the two materials are mixed. Calcium carbonate, in granular and/or powder form, is then added. The calcium carbonate acts as a filler in the finished cultured marble material. Pigment can be added at this stage if desired. The mixture has a soupy consistency much like the consistency of runny cookie dough. The surface of an appropriately shaped mold is coated with a clear layer of polyester resin commonly referred to as gel coat. After the gel coat has partially cured, the soupy resin/filler mixture is poured into the mold. After the mold is filled, the mold is vibrated in a vacuum chamber in order to release air bubbles that may have adhered to the calcium carbonate filler particles or that may have adhered to the inside surface of the gel coat or mold. The material in the mold is then allowed to cure and harden. The hardened resin holds the filler particles in place to form a matrix. The matrix, which is removed from the mold, is the cast article.

In a second example, each of the two articles is a cast article of what is sometimes called cast onxy. Aluminum trihydrate (ATH) is used as a filler, rather than calcium carbonate. In the cast onyx process, a get coat layer is not used. Otherwise, the process of making cast onyx is much the same as the cultured marble process described above except that the filler material is aluminum trihydrate rather than calcium carbonate.

In a third example, each of the two articles is a cast piece of material that has the appearance of granite. Again, ATH is used as a filler. After curing, the material is crushed into particles of the sizes of crystals that are seen in natural granite. Sheets of cast resins of different colors are crushed such that the resulting particles are of the different colors seen in natural granite. The resulting colored particles are then used as the filler material in the resin/filler process described above. When the resin cures, the particles of different colors are held in place to form a rigid matrix. The resulting material has the appearance of granite.

One of the above-described three casting processes or another suitable process is used to make each of the unitary articles 1 and 2 of FIG. 1. The threshold extension portion 2 and shower pan 1 are then assembled (typically assembled in the field at the job site) by moving the threshold extension portion 2 with respect to the shower pan 1 as illustrated by the solid arrows in FIG. 1 so that a side 3 of threshold extension portion 2 abuts a side 4 of shower pan 1. Ridge extensions 5 and 6 on the threshold extension portion 2 extend into corresponding receiving slits 7 and 8 on the shower pan. Threshold extension portion 2 is fixed in place to shower pan 1 using a suitable adhesive. Threshold extension portion 2 forms the threshold over which an individual steps when entering the finished shower enclosure. Threshold extension portion 2 also typically supports a shower door assembly.

Figure 2:
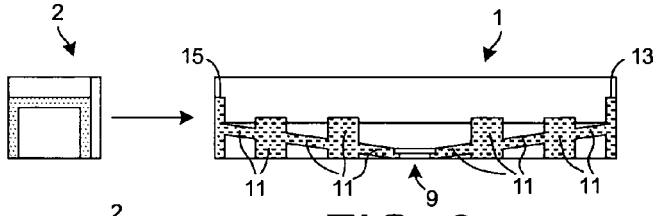
FIG. 2 is a cross-sectional view (taken along dashed line A-A in FIG. 1) of the shower pan and threshold extension portion of FIG. 1.

FIG. 2 is a cross-sectional side view of the shower pan 1 and threshold extension portion 2 taken along sectional line A-A in FIG. 1.

Figure 3:
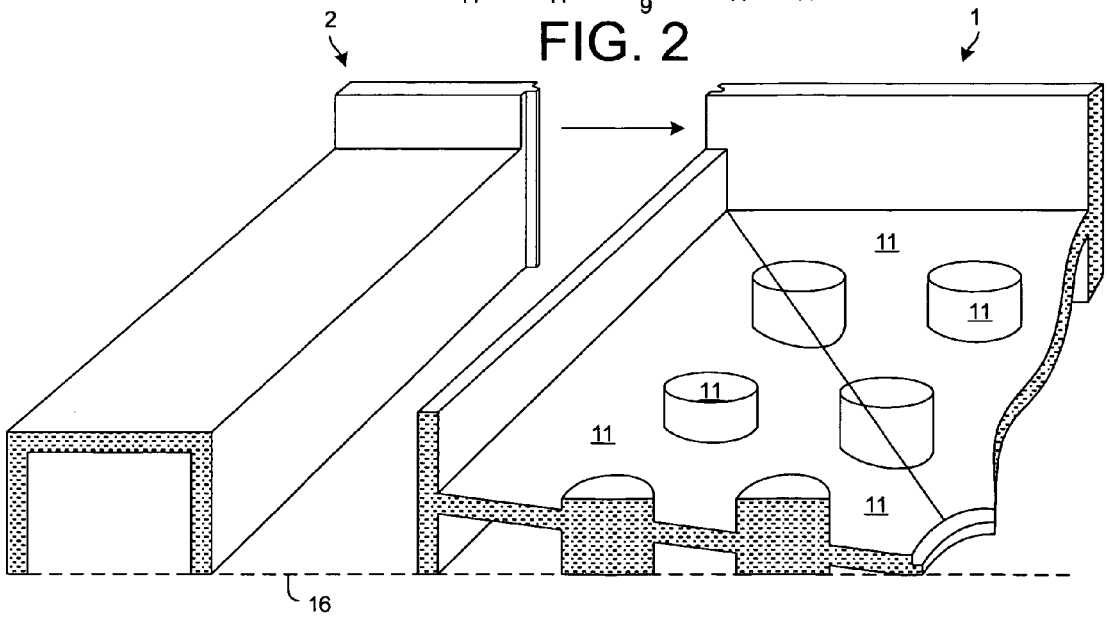
FIG. 3 is a perspective cross-sectional view (taken along dashed line A-A in FIG. 1) that illustrates how the threshold extension portion and is joined to the shower pan.

FIG. 3 is a perspective cross-sectional view taken along line A-A in FIG. 1.

Shower pan 1 is a vessel that has an open top. The vessel drains to a substantially centrally located drain orifice 9. Shower pan 1 drains in the directions of arrows 10. In the example of FIGS. 1-3, shower pan 1 includes a draining base portion 11 and four sidewalls 12-15 that extend up from draining base portion 11 such that the sidewalls define a draining area. The top edges of the four sidewalls 12-15 define an upper rim of the vessel. Sidewalls 12 and 14 extend up from the draining base portion 11 farther than do sidewalls 13 and 15.

Draining base portion 11 includes a draining portion and a support structure. The draining portion has an upper surface that drains in the directions of arrows 10 (see FIG. 1) to drain orifice 9.

The support structure is for supporting a slab floor member (the slab floor member is not shown in FIGS. 1-3, see reference numeral 24 in FIGS. 4 and 5) in the shower pan such that a substantially planar upper surface of the slab floor member will have a slight downward incline in the direction of sidewall 12. The slab floor member also has a substantially planar bottom surface. In the illustrated example of FIGS. 1-3, the support structure includes a plurality of columnar pedestals. Each pedestal extends in an upward direction and terminates in an upward-facing planar bearing surface. These upward-facing planar bearing surfaces are illustrated in FIG. 1 as circles. All of these upward-facing planar bearing surfaces lie in a single support plane. The support plane is oriented to tilt toward sidewall 12 such that the pedestals at the left of FIG. 1 that neighbor sidewall 12 are shorter than the corresponding pedestals at the right of FIG. 1 that neighbor sidewall 14.

The support structure is formed so that it can support a slab floor member of a finishing material (for example, granite or marble). Natural finishing materials such as granite and marble may have fissures and weak points. A non-reinforced slab of such a natural material, if not properly supported from below, may crack. The support structure of the novel shower pan therefore extends up to the support plane in at least one location in each two-foot by two-foot square of the draining area. Where the support structure is a plurality of pedestals as in the example of FIGS. 1-3, at least a portion of one of the upward-facing planar bearing surfaces extends up to the support plane at some location within each two-foot by two-foot square of the draining area.

Although the slab floor member can be made of natural granite or marble, it is to be understood that numerous other materials can be used. An engineered stone material known as Silestone can be employed as a slab floor member in a particularly desirable and aesthetically pleasing fashion. The slab floor member can also be made of cultured marble, cultured onyx or cultured granite. The slab floor member can be a single piece of ceramic, or a plurality of pieces of ceramic disposed on a rigid backing material. In the example of FIGS. 1-3, the slab floor member is a single slab of engineered stone that has a continuous, substantially planar upper surface that is free of joints.

In the example of FIGS. 1-3, each pedestal of the support structure also extends downward from the bottom surface of draining base portion 11 to a floor plane. The floor plane is illustrated in FIG. 3 by dashed line 16. Floor plane 16 is the plane of an upper surface of a subfloor upon which shower pan 1 is disposed when installed. Because the pedestals extend from floor plane 16 up to the support plane, the weight of the slab floor member is transferred by the pedestals through the shower pan and to the subfloor.

Figure 4:
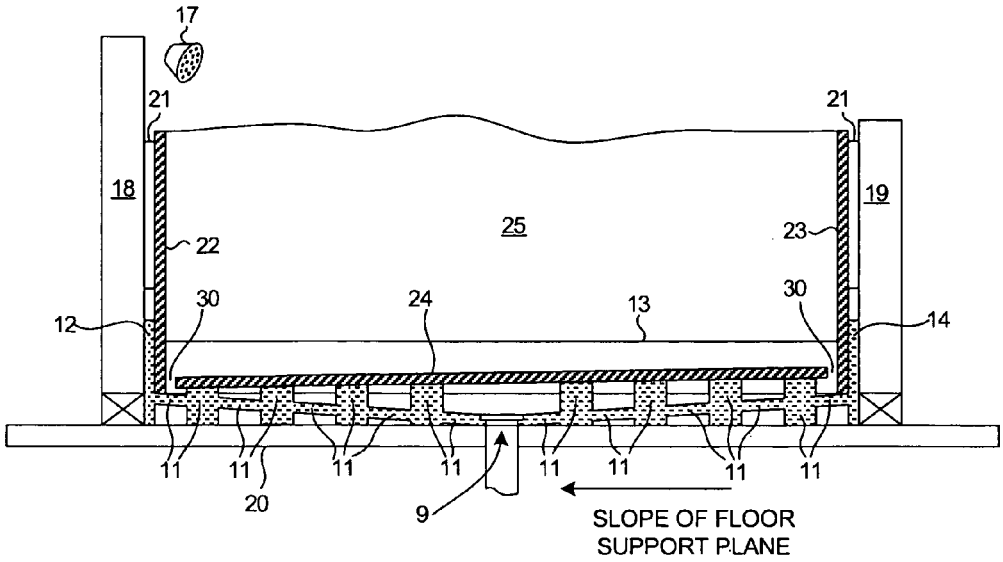
FIG. 4 is a cross-sectional diagram (taken along dashed line B-B in FIG. 1) of a finished installation of the shower pan of FIG. 1, wherein the inside of the shower enclosure is clad in a finishing material (for example, sheets of granite), and wherein the supporting structure of the shower pan supports a slab floor member (for example, a rectangular sheet of granite).

FIG. 4 is a cross-sectional diagram of the shower pan 1 of FIG. 1 in a finished installation in a shower enclosure realized using wood frame construction. The support plane of the support structure has a slight incline in one direction with respect to the floor plane such that the support plane is not parallel to the floor plane. Reference numeral 16 (see FIG. 3) identifies the floor plane. A portion of the shower pan 1 (in the support plane) makes contact with the bottom surface of the slab floor member 24 in each two-foot by two-foot square of the bottom surface of the slab floor member 24. In the cross-sectional diagram of FIG. 4, the sheet 23 of engineered stone is seen extending down into the draining area of shower pan 1 such that a major planar surface of sheet 23 substantially perpendicularly intersects the plane of the upper surface of slab floor member 24.

Figure 5:
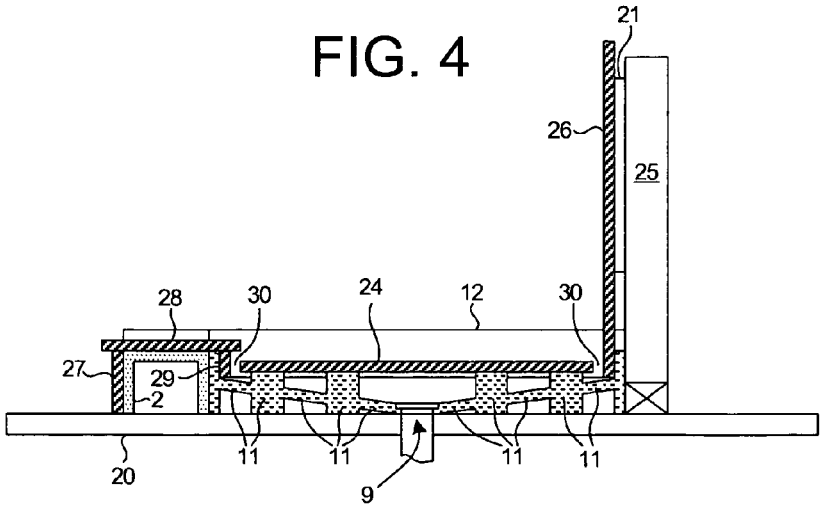
FIG. 5 is a cross-sectional diagram (taken along dashed line A-A of FIG. 1) of the finished installation of the shower pan of FIG. 4, wherein the threshold extension portion is clad in sheets of the finishing material (for example, pieces of granite).
Figure 6:
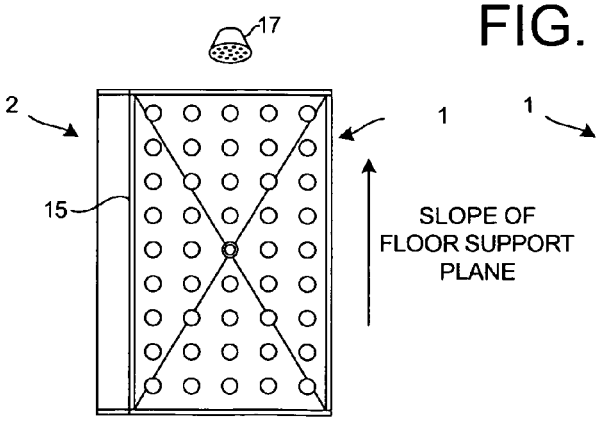
FIG. 6 is a top-down diagram of the threshold extension portion 2 attached to sidewall 15 of the shower pan of FIG. 1.
Figure 7:
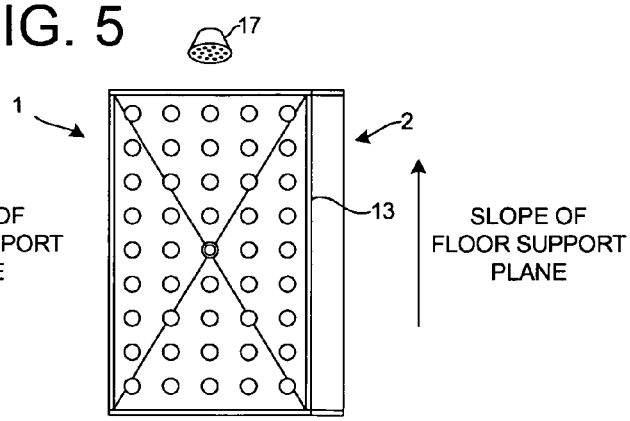
FIG. 7 is a top-down diagram of the threshold extension portion attached to sidewall 13 of the shower pan of FIG. 1.

FIG. 5 is a cross-sectional diagram of the shower pan 1 of FIG. 1 in the finished installation of FIG. 4. Note that the threshold extension portion 2 is attached to shower pan 1 so that the threshold extension portion 2 is on the correct side of the shower pan when the support plane of the support structure of the shower pan tilts toward the wall upon which the shower head 17 is mounted. If, for example, the shower head 17 were to be disposed on the left wall as the shower enclosure is entered, then the threshold extension portion 2 would be attached to sidewall 15 of the shower pan as illustrated in FIG. 6. If, for example, the shower head 17 were to be disposed on the right wall as the shower enclosure is entered, then the threshold extension portion 2 would be attached to sidewall 13 as illustrated in FIG. 7.

Shower pan 1 is installed so that it abuts walls 18 and 19 of the shower enclosure and so that it rests on the subfloor 20 as illustrated in FIG. 4. In the illustrated example, walls 18 and 19 are roughed-in wood stud walls. The drain orifice 9 is then coupled to the plumbing of the building. Green board drywalling material 21 is applied to the enclosure side of the walls 18 and 19 as illustrated. At this rough-in stage of construction, a disposable slab floor member (not shown) is disposed on the support structure of shower pan 1 to protect the draining base portion 11 of shower pan 1 from being scratched and damaged by construction workers and construction debris. The disposable slab floor member may, for example, be provided along with the shower pan and threshold extension portion by the manufacturer of the shower pan. The shower pan may be shipped from the manufacturer with the disposable slab floor member attached.

When the shower enclosure is to be finished after the rough-in stage of construction, the inside walls of the shower enclosure are finished with a finishing material of choice. In the illustrated example, each of the walls 18 and 19 of the shower enclosure is covered with a respective unitary sheet of engineered stone 22 and 23. To simplify the illustration of FIG. 4, no sheet of engineered stone is illustrated on back wall 25. FIG. 5 shows a unitary sheet of engineered stone 26 that covers back wall 25. Each sheet of engineered stone extends down past the rim of shower pan 1 as illustrated in FIGS. 4 and 5. The sheets of engineered stone are fixed to the green board drywall material 21.

The disposable slab floor member is then removed and the final slab floor member 24 is placed on the support structure (pedestals in this example) of shower pan 1. The final slab floor member 24 is sized so that it extends laterally along the support plane to within six inches of each of the sidewalls of the shower pan. The upper surface area of final slab floor member 24 is more than seventy-five percent of the area of the draining area of shower pan 1. The upper surface of final slab floor member 24 may be textured to avoid an individual slipping on the surface when the shower is in use. Additional pieces 27-29 of engineered stone are applied to clad the threshold extension portion 2 as illustrated in FIG. 5.

The final slab floor member 24 covers substantially all of the visible draining area of the finished assembly as viewed from the top-down perspective but for a strip-like gap 30 that extends around the periphery of slab floor member 24 between slab floor member 24 and the engineered stone sheets 22, 23 and 26 on the walls of the shower enclosure and between slab floor member 24 and engineered stone piece 29 that clads the side of threshold extension portion 2. The upper surface of slab floor member 24 tilts very slightly in the direction of wall 18 that carries shower head 17. When the shower is in use, water from shower head 17 falls on the upper surface of slab floor member 24. This water can flow across the upper surface of slab floor member 24 and to gap 30 in any direction. The water flows downward through gap 30, onto the upper surface of draining base portion 11, and is conducted by draining base portion 11 under slab floor member 24 and to drain orifice 9. The portion the draining base portion 11 that drains to the drain orifice is called the draining portion of draining base portion 11. The drain orifice is this example is located underneath the slab floor member 24.

Figure 8:
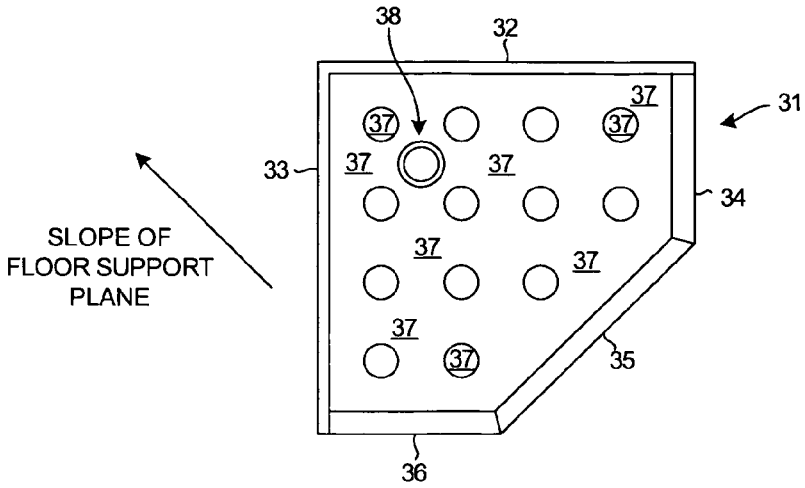
FIG. 8 is a top-down diagram of another shape that the novel shower pan can have.

Although a rectangular shower pan is described above, the novel shower pan design can be applied to shower pans of other shapes. FIG. 8 is a top-down diagram of a novel shower pan 31 having one such shape. Shower pan 31 has two sidewalls 32 and 33 and a threshold 34, 35 and 36. Unlike the threshold of the embodiment of FIGS. 1-3, the threshold of the embodiment of FIG. 8 is integrally formed with the remainder of the shower pan. A separate threshold extension portion that can be fixed to multiple sides of the shower pan is not provided because the shower enclosure in the example of FIG. 8 is always to be entered from the same location. The slab floor member (not shown) for shower pan 31 has a five-sided polygonal shape. The pedestals of the support structure of draining base portion 37 are illustrated in FIG. 8 as circles. These pedestals support the slab floor member (not shown) in the shower pan such that the upper surface of the slab floor member slopes gently in the direction of the arrow. The upper surface of the draining portion of draining base portion 37 of the shower pan drains toward drain orifice 38.

Figure 9:
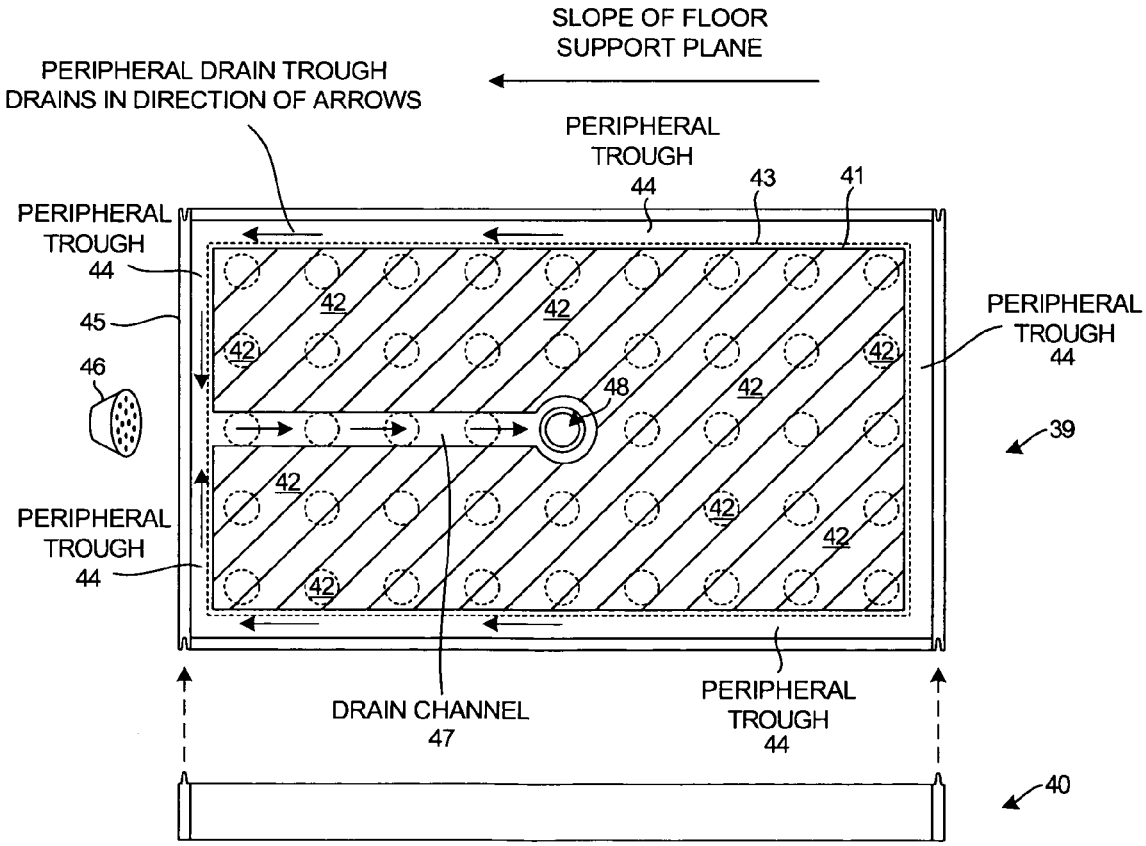
FIG. 9 is a top-down diagram of another embodiment of the novel shower pan wherein the support structure supports and touches a large proportion of the bottom surface area of the slab floor member, and wherein water that spills off the slab floor member is conducted to a central drain orifice by a system of drain troughs (a peripheral drain trough and a drain trough that extends from the peripheral drain trough inward and to a central drain orifice) formed by the upper surface of the draining base portion of the shower pan.

FIG. 9 is a simplified top-down diagram of a shower pan 39 in accordance with another novel aspect. Shower pan 39 mates with a threshold extension portion 40 as described above in connection with shower pan 1 and threshold extension portion 2. In the example of FIG. 9, however, the bearing surface of the support structure that supports the slab floor member (not shown) is not a plurality of upward-facing circular bearing surfaces as in the embodiment of FIGS. 1-3. Rather, the bearing surface of the support structure of the embodiment of FIG. 9 is a single contiguous surface 41 illustrated as a dashed area in FIG. 9. This single contiguous surface 41 is an upper surface of a central part of the draining base portion 42 of the shower pan. The bearing surface 41 is disposed in the support plane as described in connection with the embodiment of FIGS. 1-3. The support structure of the embodiment of FIG. 9 also includes supporting pedestals that extend downward from the bottom surface of the draining base portion 42 down to the floor plane. The pedestals are illustrated in FIG. 9 as dashed circles. When the slab floor member is disposed in the shower pan and is supported by the bearing surface 41, the peripheral edge of the slab floor member is as illustrated by dashed line 43. A draining portion of draining base portion 42 forms a peripheral drain trough 44 that extends around the support structure. The peripheral drain trough 44 drains in the directions of the arrows in FIG. 9 to a location close to sidewall 45. Sidewall 45 is the sidewall to which the support plane tilts and is the sidewall that abuts the enclosure wall on which the shower head 46 is to be mounted. The draining portion also includes a drain channel 47 that extends from this location close to sidewall 45 and to a drain orifice 48. The embodiment of FIG. 9 has a smaller amount of open air volume underneath the slab floor member between the slab floor member and the shower pan than does the embodiment of FIGS. 1-3. The smaller volume reduces the area available for mold and mildew to grow and reduces the volume for hair and soap scum to collect.

Figure 10:
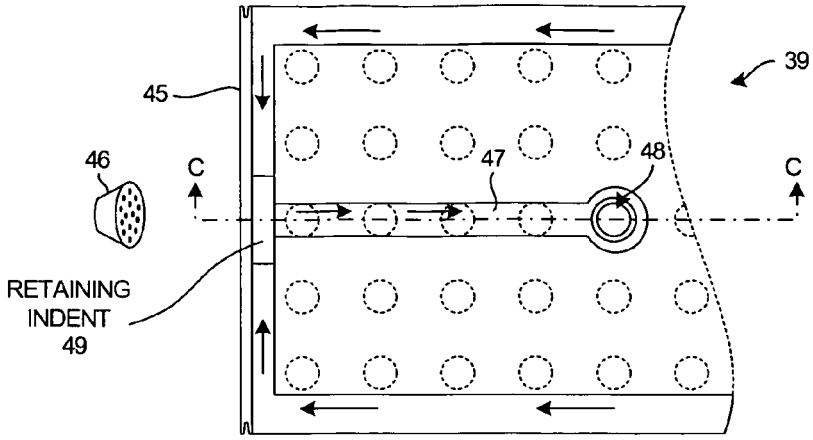
FIG. 10 is a top-down diagram showing a retaining indent in the shower pan of FIG. 9, wherein the retaining indent is fashioned to retain a screen or grill.

FIG. 10 illustrates a retaining indent 49 in the upper surface of the drain trough 44 of shower pan 39. Retaining indent 49 is provided to retain a screen or grill 50.

Figure 11:
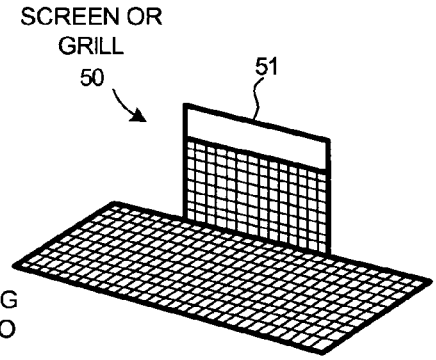
FIG. 11 is a perspective diagram of a screen or grill that can be removably disposed in the retaining indent of FIG. 10.

FIG. 11 is a diagram of the screen or grill 50.

Figure 12:
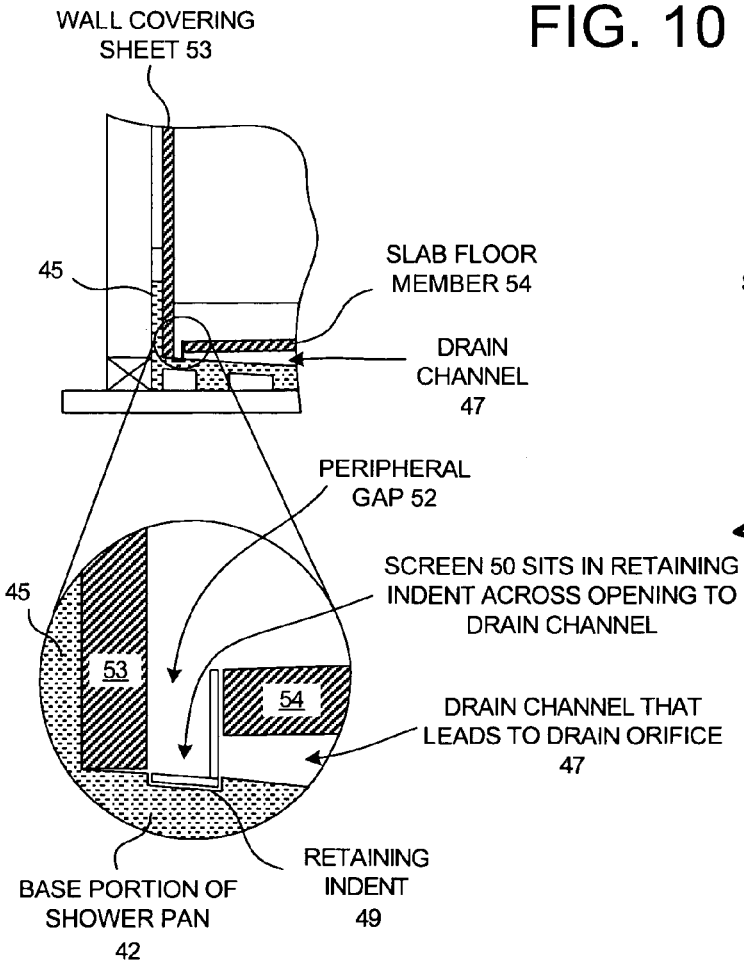
FIG. 12 is an exploded cross-sectional view of the screen or grill of FIG. 11 disposed in the retaining indent of FIG. 10.

FIG. 12 is an exploded cross-sectional view taken along sectional line C-C in FIG. 1. The exploded view illustrates how screen or grill 50 can be placed in retaining indent 49 such that screen or grill 50 is disposed across the opening to drain channel 47. When disposed in this manner, screen or grill 50 filters all water that flows into drain channel 47 and to drain orifice 48. Screen or grill 50 can be removed by grasping the top portion 51 of screen or grill 50 from above, and then lifting the screen or grill 50 upward and out of the peripheral gap 52 between wall covering sheet 53 and the slab floor member 54. After cleaning, the screen or grill 50 can be replaced by slipping the screen or grill back down through gap 52 and into retaining indent 49.

Although the present invention has been described in connection with certain specific embodiments for instructional purposes, the present invention is not limited thereto. Although two forms of the support structure are described above that support each two-foot by two-foot square of the slab floor member, namely an array of supporting pedestals and the single contiguous bearing surface structure of FIG. 9, the support structure can take numerous other forms. Although a peripheral gap is described that extends around all four edges of a rectangular slab floor member, a peripheral gap need not extend around all edges of a slab floor member. In some embodiments, only one edge of the slab floor member terminates in a peripheral gap. In other embodiments, two edges of the slab floor member terminate in a peripheral gap. In other embodiments, three edges of the slab floor member terminate in a peripheral gap. Similarly, where a peripheral drain trough is provided in the upper surface of the shower pan, the peripheral drain trough need not extend under all edges of the slab floor member in all embodiments. In some embodiments, an edge or edges of the slab floor member is or are joined to the sheets of cladding material that clad walls of the shower enclosure or that clad the shower threshold. Although the drain orifice is illustrated in the embodiments of FIGS. 1-3 as being disposed toward the center of the shower pan when the shower pan is viewed from a top-down perspective, the drain orifice is disposed at a side of the shower pan in some embodiments. Although a threshold extension portion is disclosed that is glued to a shower pan, other mechanisms for attaching the threshold extension portions are possible. For example, in some embodiments the threshold extension portion and the shower pan are keyed and overlap one another and fit together such that the threshold extension portion forms a rigid and waterproof seal with the shower pan without the use of adhesive. A slab floor member may include a single sheet of natural stone bonded to a rigid backing material. The single sheet of natural stone provides the substantially planar upper surface of the slab floor member so that the upper surface is a continuous, joint-free surface of the natural stone. Accordingly, various modifications, adaptations, and combinations of various features of the described embodiments can be practiced without departing from the scope of the invention as set forth in the claims.

What is claimed is:

1. A cast shower pan comprising:

a plurality of sidewalls; and a draining base portion that defines a draining area when the cast shower pan is viewed from a top-down perspective, the cast shower pan draining the draining area to a drain orifice, wherein the draining base portion comprises:

a support structure for supporting a slab floor member over the drain orifice, the support structure extending up and terminating in one or more bearing surfaces disposed in a support plane, wherein the support plane is sloped to have a slight downward incline in one direction, wherein the support structure extends up to the support plane in at least one location in each two-foot by two-foot square of the draining area; and a draining portion that drains to the drain orifice.

2. The cast shower pan of claim 1, wherein the sidewalls extend up from the draining base portion, the drain orifice being an orifice in the draining base portion, the support structure comprising a plurality of pedestals that extend up to the support plane, each pedestal terminating in an upward-facing bearing surface, all the upward-facing bearing surfaces being disposed in the support plane.

3. The cast shower pan of claim 1, wherein the drain orifice is disposed below the support plane when the cast shower pan is viewed from the top-down perspective.

4. The cast shower pan of claim 3, wherein the sidewalls define an upper rim of the cast shower pan, the support plane being disposed below the upper rim when the cast shower pan is viewed from the top-down perspective.

5. The cast shower pan of claim 1, wherein the cast shower pan is adapted to rest on a floor, the floor having an upper surface disposed in a floor plane, and wherein the support plane has the slight downward incline in one direction with respect to the floor plane such that the support plane is not parallel to the floor plane.

6. An assembly comprising:

a unitary cast shower pan comprising a draining base portion and a plurality of sidewalls, the sidewalls extending upward from the draining base portion and defining a draining area that drains to a drain orifice; and a slab floor member that has a substantially planar upper surface, the slab floor member being disposed in the shower pan, the slab floor member extending to within six inches of each of the sidewalls of the shower pan, the shower pan supporting the slab floor member such that the substantially planar upper surface of the slab floor member has a slight tilt, wherein a portion of the shower pan makes contact with a bottom surface of the slab floor member in each two-foot by two-foot square of the bottom surface of the slab floor member.

7. The assembly of claim 6, wherein the substantially planar upper surface of the slab floor member has a surface area that is more than seventy-five percent of the draining area.

8. The assembly of claim 7, wherein the upper surface of the slab floor member is a continuous substantially planar surface of a material taken from the group consisting of: granite, marble and engineered stone.

9. The assembly of claim 7, wherein the slab floor member has a peripheral edge, and wherein water from a shower head falls on the upper surface of the slab floor member, flows across the upper surface of the slab floor member, passes over the peripheral edge and onto the draining base portion of the unitary cast shower pan, and is conducted by the unitary cast shower pan underneath the slab floor member to the drain orifice.

10. The assembly of claim 7, wherein the slab floor member is not fixed to the unitary cast shower pan but rather rests on and directly contacts a plurality of upwardly extending pedestals of the unitary cast shower pan.

11. The assembly of claim 6, wherein the unitary cast shower pan has a first sidewall, a second sidewall, and a third sidewall, and wherein the slab floor member has a first peripheral side edge, a second peripheral side edge, and a third peripheral side edge, the first peripheral side edge extending parallel to the first sidewall, the second peripheral side edge extending parallel to the second sidewall, the third peripheral side edge extending parallel to the third sidewall.

12. A method comprising:

supporting a slab floor member in a cast shower pan such that a substantially planar upper surface of the slab floor member has a slight tilt, the cast shower pan having a draining area that drains to a drain orifice, the drain orifice being located underneath the slab floor member, wherein a surface area of the upper surface of the slab floor member is more than seventy-five percent of the draining area of the cast shower pan, wherein the slab floor member is supported such that the shower pan directly contacts each two-foot by two-foot square portion of a substantially planar bottom surface of the slab floor member, and wherein the slab floor member has a peripheral edge; and conducting water that flows over the peripheral edge across a surface of the cast shower pan under the slab floor member and to the drain orifice.

13. The method of claim 12, wherein the cast shower pan is a unitary cast resin article, and wherein the slab floor member includes no cast resin.

14. The method of claim 13, wherein the slab floor member is composed substantially entirely of a material taken from the group consisting of: granite, marble, and engineered stone.

15. The method of claim 12, wherein the substantially planar upper surface of the slab floor member is a surface of a material taken from the group consisting essentially of: granite, marble, and an engineered stone material.

16. The method of claim 12, wherein the slab floor member is a single piece of a material taken from the group consisting of: granite, marble, and an engineered stone material.

17. The method of claim 12, wherein the substantially planar upper surface of the slab floor member has a rectangular shape, wherein the substantially planar upper surface of the rectangular shape is a continuous joint-free water-impervious surface.

18. An assembly comprising:

a unitary cast shower pan comprising a draining base portion and a plurality of sidewalls, the sidewalls extending upward from the draining base portion and defining a draining area that drains to a drain orifice; and a rectangular slab floor member that has a substantially planar rectangular upper surface, the substantially planar rectangular upper surface being a substantially continuous joint-free water-impervious surface, the substantially continuous joint-free water-impervious surface being of a material taken from the group consisting of: granite, marble, and engineered stone, wherein the substantially planar rectangular upper surface has a surface area that is more than seventy-five percent of the draining area of the unitary cast shower pan, and wherein a portion of the unitary cast shower pan makes contact with a bottom surface of the rectangular slab floor member in each two-foot by two-foot square of the bottom surface of the rectangular slab floor member.

19. The assembly of claim 18, wherein the rectangular slab floor member rests on and directly contacts a plurality of upwardly extending portions of the unitary cast shower pan such that an upper surface of the rectangular slab floor member has a slight tilt.

20. The assembly of claim 18, further comprising:

a second sheet of the material, the second sheet extending into the draining area of the unitary cast shower pan, the second sheet having a major planar surface, wherein the upper surface of the rectangular slab floor member extends in a plane, and wherein the second sheet is disposed such that the major planar surface of the second sheet substantially perpendicularly intersects the plane in which the upper surface of the rectangular slab floor member extends.

21. The assembly of claim 18, wherein the unitary shower pan comprises a means for making contact with and supporting the rectangular slab floor member such that the substantially planar rectangular upper surface of the rectangular slab floor member has a slight tilt.

* * * * *